US005292293A

United States Patent [19]

Schumacher

[11] Patent Number: 5,292,293

[45] Date of Patent: Mar. 8, 1994

[54] PROGRAMMABLE PHYSICAL EXERCISE APPARATUS WITH INERTIA

[76] Inventor: Jean-Michel Schumacher, Rue de la Coutare 36, B-4821 Andrimont, Belgium

[21] Appl. No.: 969,812

[22] PCT Filed: May 15, 1992

[86] PCT No.: PCT/BE92/00020

§ 371 Date: Mar. 11, 1993

§ 102(e) Date: Mar. 11, 1993

[87] PCT Pub. No.: WO92/20408

PCT Pub. Date: Nov. 26, 1992

[30] Foreign Application Priority Data

May 17, 1991 [BE] Belgium ..... 9100470

[51] Int. Cl.[5] ..... A63B 24/00

[52] U.S. Cl. ..... 482/4; 482/5; 482/6; 482/119

[58] Field of Search ..... 482/1, 2, 4–9, 482/54, 57, 61, 63–65, 900–904, 119

[56] References Cited

U.S. PATENT DOCUMENTS 4,786,049 11/1988 Lautenschlager ..... 482/9
4,934,692 6/1990 Owens ..... 482/63
5,029,846 7/1991 Hao ..... 482/119 X

*Primary Examiner*—Richard J. Apley
*Assistant Examiner*—Glenn E. Richman
*Attorney, Agent, or Firm*—Charles F. Meroni, Jr.

[57] ABSTRACT

A training machine comprising a frame on which is mounted an element freely rotating about a horizontal axis, and an inertial flywheel coupled to said rotating element. A strap is tightened about the flywheel. The rotating element is mechanically coupled to said flywheel and a microprocessor is mounted on the frame to provide a control signal for the adjustable traction device. Said control signal corresponds to an adjustable and predefined simulated difficulty to be encountered. The microprocessor is designed to store the torques theoretically needed for several predefined simulated runs and, in response to a signal corresponding to the actual torque, to generate a second signal corresponding to the variation in the torque required to attain the torque theoretically needed for the corresponding simulated run, the second signal controlling the adjustable traction device.

6 Claims, 4 Drawing Sheets

FIG. 4
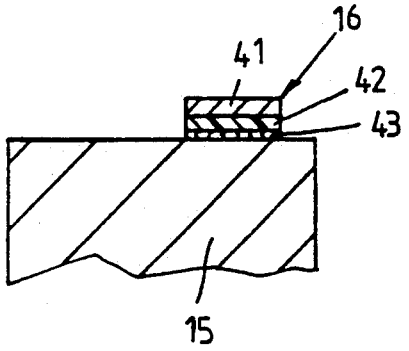
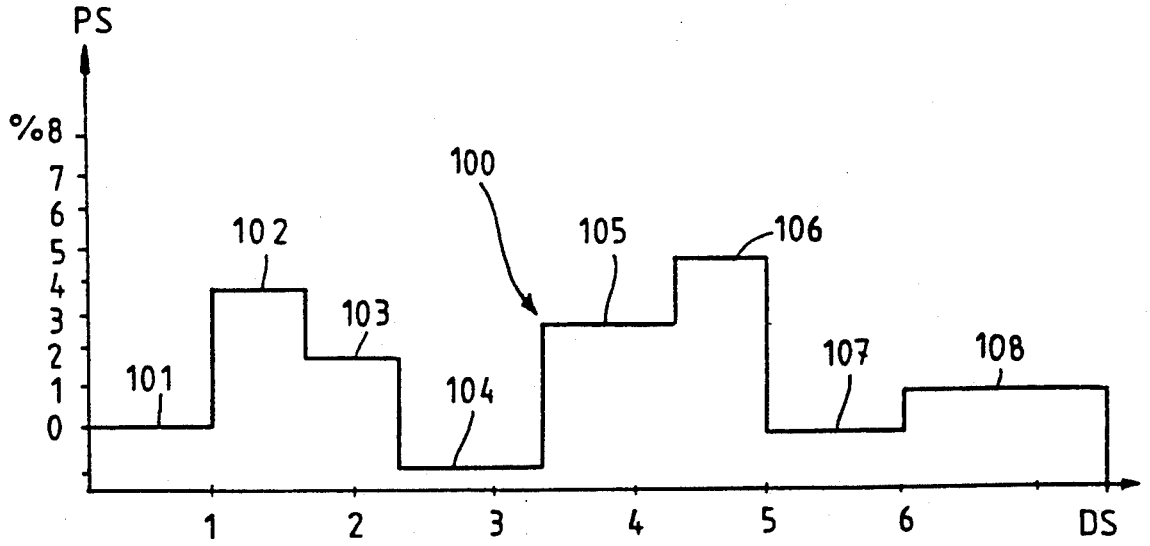
FIG. 5

PROGRAMMABLE PHYSICAL EXERCISE APPARATUS WITH INERTIA

FIELD OF INVENTION

The present invention relates to an apparatus for enabling an individual to undertake physical exercise and training with the aid of a pedal drive mechanism.

BACKGROUND OF THE INVENTION

The prior art includes an indoor machine known as a bicycle ergometer which essentially comprises a pedal drive mechanism mounted on an immobile stand. Such a machine, however, does not offer the chance to control or program one's exercises. However, this known machine hardly motivates one to exercise as it can never give the user a sensation of speed similar to that which he would experience when riding a bicycle on a road.

SUMMARY OF INVENTION

To help to overcome this lack, the present invention provides a physical exercise apparatus comprising a stand on which are mounted a rotary member mounted so as to be able to turn freely about a horizontal pin, an inertia flywheel coupled to the rotary member, and a strap clamped around part of the perimeter of the inertia flywheel, and attached at one end to a pin fixed to the stand and attached at its opposite end to the end of a spring, the other end of the spring being connected to an adjustable traction device mounted on the stand in such a way as to exert a predetermined tensile force on the spring and strap.

In the apparatus according to the invention, the rotary member is coupled mechanically to the inertia flywheel, and the apparatus also comprises a microprocessor mounted on the stand to produce a control signal for the adjustable traction device, the control signal representing the predetermined adjustable difficulty of a leg of a simulated journey, the microprocessor being organized so as to store the theoretically required torques for a number of predetermined simulated legs and, in response to a signal representing the effective torque, to generate a second signal representing the required change of torque to reach the theoretically required torque for the corresponding simulated leg, the second said signal being used to control the adjustable traction device.

The said rotary member may be coupled to the chainring of a bicycle designed for mounting on the apparatus or be coupled to a chainring which is itself fixed to the apparatus.

The inertia flywheel is coupled mechanically to a device for measuring the change in the drive torque relative to the braking force exerted by the inertia flywheel and for producing an electrical signal representing said change.

In an illustrative embodiment, the device for measuring the change in the drive torque relative to the braking force comprises a drive pinion designed to be driven by a pedal drive mechanism and a pulley coupled mechanically to the inertia flywheel, said pulley being also coupled to the drive pinion by means of a number of compressed springs, each spring being held between a first ball fixed to the drive pinion and a second ball fixed to the pulley, a number of first annular segments fixed to the perimeter of the pulley and a number of second annular segments fixed to the perimeter of the pinion, the said first and second annular segments being arranged in such a way that the mutually confronting ends of each first annular segment and the consecutive second annular segment are separated, forming a slot which is proportional to the braking force, and a device for measuring the length of said slots and for producing electrical signals representing the change in length of said slots.

The microprocessor is connected up to receive the electrical signal representing the change in the drive torque relative to the braking force and is programmed to determine the gear change required to travel a simulated leg of a journey and overcome the simulated gradient it represents.

Different exercise programs may be stored in the microprocessor, each program comprising a sequence of levels having different degrees of difficulty both of braking force (simulating a gradient) and of distance or duration. In this way the user has the sensation of following a real road journey and is able to select any stored program to suit his physical ability or his need for exercise.

The microprocessor may also be programmed to create a topographical simulation composed by the user himself according to his physical fitness or according to his physical performance or desired performance. The memory of the microprocessor is loaded with a range of levels of different difficulties (for example more than 10 levels) which allow the user to vary his physical exercises and their difficulties from a menu.

The apparatus according to the invention has the advantage of automatically and programably adjusting the physical effort in the course of the exercises and of creating a motivating programable simulation which gives the user a sensation of speed similar to what he would experience when riding a bicycle along a road.

BRIEF DESCRIPTION OF DRAWINGS

The invention is explained in greater detail below with the aid of the enclosed drawings in which:

FIG. 4 is a view in section of a detail of the flywheel shown in FIG. 1.

FIG. 5 is a diagram showing an example of the simulation created by the apparatus according to the invention.

DESCRIPTION OF THE PREFERRED EMBODIMENT

Figure 1:
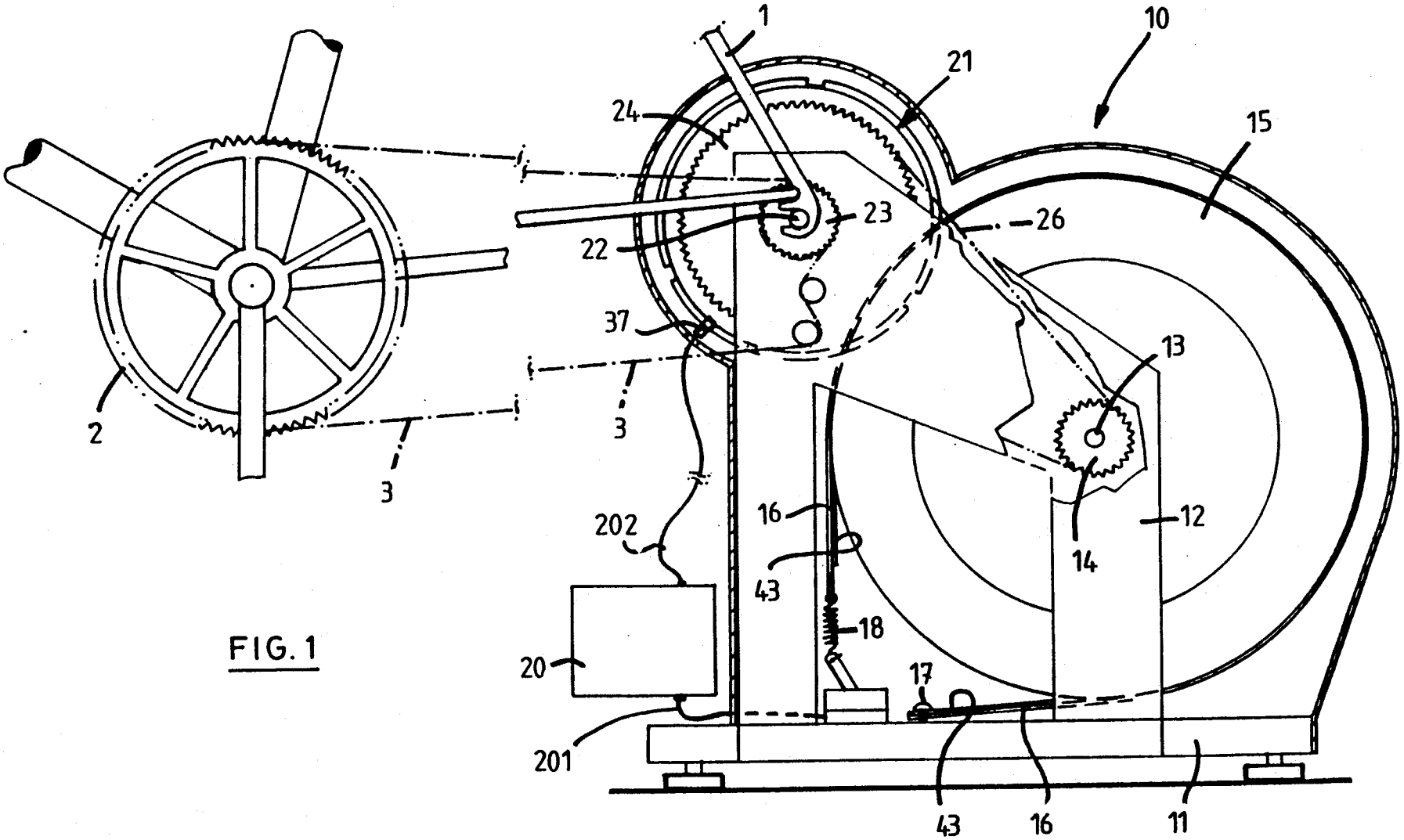
FIG. 1 is an elevation, with partial cutaway, of a first illustrative embodiment of the invention.

The illustrative embodiment of the invention shown in FIG. 1 consists of an apparatus designed to support and interact with the drive wheel of a bicycle whose frame, of which the rear part only is shown, is fixed to the apparatus 10 according to the invention by means of its rear fork 1 as shown in the drawing. The reference number 2 indicates the chainring of the pedal drive mechanism of the bicycle.

The apparatus 10 according to the invention comprises a stand 11 on which an inertia flywheel 15 is mounted rotating freely about an axle 13 fixed between end plates 12 integral with the stand 11. A strap 16 is clamped around part of the perimeter of the inertia flywheel 15: one end of the strap is fixed to a retaining pin 17 fastened to the stand and the other end of the strap is attached to a traction spring 18. This spring in turn is attached to an arm of an adjustable traction device 19, for example a geared motor, intended to exert on the spring 18 an adjustable predetermined tensile force of which the effect is to clamp the strap round the rim of the inertia flywheel and thereby oppose the rotation of this flywheel with a predetermined resistance.

In a preferred embodiment illustrated in FIG. 4, the strap 16 is a steel band 41 placed around the rim of the flywheel 15 with an interposed leather band 42 and a textile band 43, the last-mentioned being in contact with the flywheel 15 rim. The leather band and the textile band are attached at one end with the steel band to the pin 17, to which the steel band 41 is also attached. The opposite ends of the leather and textile bands are free. The dimensional stability of the steel band ensures that the clamping force is precisely determined and adjustable. The leather band distributes the clamping force over that portion of the flywheel 15 on which it acts and the textile band guarantees excellent friction. The textile band may be made from a synthetic textile such as a nylon woven. In this embodiment, the predetermined tensile force exerted on the spring 18 and hence on the strap 16 creates on the inertia flywheel 15 a precisely determined, stable and reproducible braking force, which makes it possible to program a simulation of braking forces that can be spread in a precise manner over time.

Figure 2:
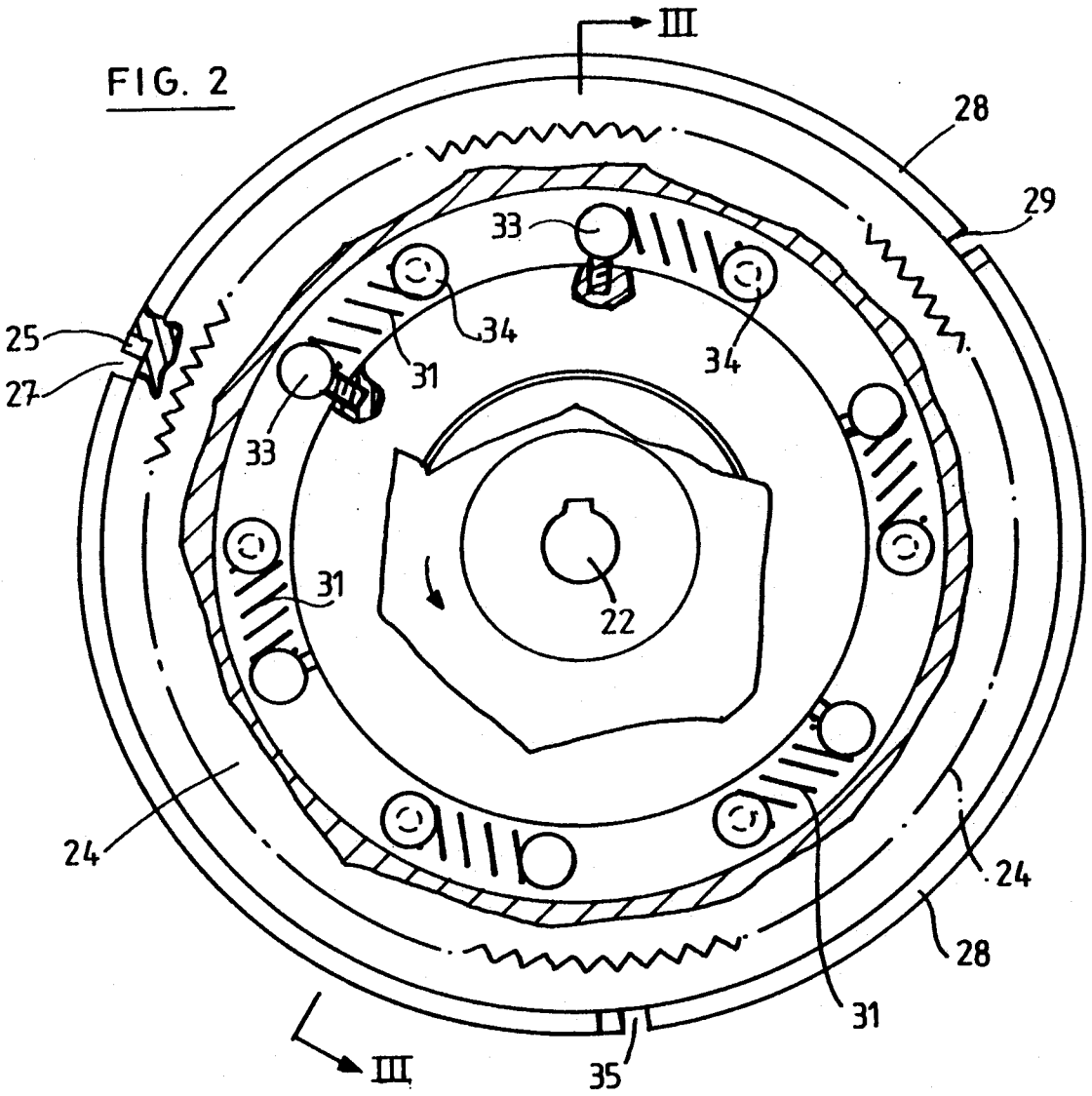
FIG. 2 is an enlarged view, with partial cutaway, of the dynamometer device shown in FIG. 1.
Figure 3:
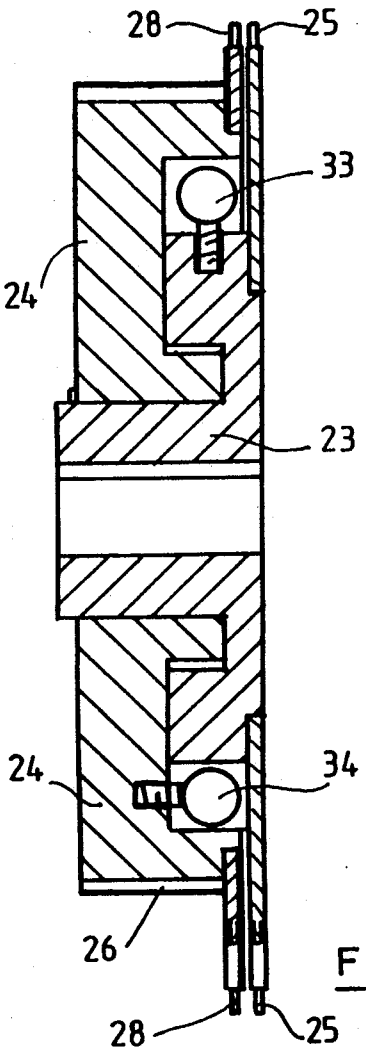
FIG. 3 is a section taken through the line III—III shown in FIG. 2.

Returning to FIG. 1, the adjustable traction device 19 is controlled electronically by a programable microprocessor 20 organized to modify the braking force exerted by the inertia flywheel as a function of a predetermined stored program in order to simulate a series of predetermined levels of difficulty of journeys and exercises. The traction device 19 receives its control signal down a line to 201. The alteration of the braking force is calculated using an appropriate measuring system. In an illustrative embodiment shown in FIG. 1, said measuring system is a dynamometric device 21 which is shown on a larger scale in FIGS. 2 and 3.

Mounted on an axle 22 fixed between the end plates 12 is a drive hub 23 which is coupled to the chainring 2 of the bicycle pedal drive mechanism by means of the bicycle chain 3. Mounted freely about the hub 23 is a pulley 24 which is coupled to the hub 14 of the inertia flywheel 15 via a belt 26. The drive hub 23 carries several annular segments 25, for example three segments as illustrated, these segments being distributed around the perimeter of the drive hub 23, leaving free spaces 27 between themselves. The pulley 24, in turn, carries an equal number of annular segments 28 distributed around the perimeter of the pulley, leaving free spaces 29 between themselves, the segments 28 being practically parallel to the segments 25.

The drive hub 23 and the pulley 24 are coupled dynamometrically to each other by means of compression springs 31 distributed around a circular ring 32, each spring 31 being held in compression between two balls 33 and 34, one of the balls of each pair of balls, for example ball 33, being fixed to the hub 23 while the other ball of the pair of balls, for example ball 34, is fixed to the pulley 24.

The degree of compression of the springs 31 varies as a function of the relative movement of the drive hub 23 with respect to the pulley 24. The drive hub 23 is driven by the rotation of the chainring 2 of the pedal drive mechanism, in other words by the person using the apparatus, and the pulley 24 is driven by the braking force exerted by the inertia flywheel 15. If the annular segments 25 and 28 are arranged around the perimeter of the hub 23 and pulley 24, respectively, so that the mutually confronting ends of one segment 25 and of the consecutive segment 28 are separated from each other by a predetermined slot 35, the length of each slot 35 will vary as a function of the difference between the drive torque provided by the pedal drive mechanism and the braking torque exerted by the inertia flywheel 15: for a given drive torque, the greater the braking torque, the more the springs 31 will become compressed and the more the slots 35 will lengthen. An optical switch 37 measures the open periods of the slots and the closed periods between the slots and on each occasion generates a signal which it sends to the microprocessor 20 down the line 202.

The microprocessor receives these signals regularly in the course of each revolution of the drive hub and on each occasion calculates the value of the instantaneous torque, which is proportional to the quotient of the percentage of opening of a slot to the percentage of closing between the two successive slots. The microprocessor works out the average value of the torque for each revolution of the pedal drive mechanism, compares this average value with the stored torque value for a programmed simulated leg of a journey and sends down the line 201 a control signal for the traction device 19 so that the latter exerts on the belt 16 a predetermined tensile force corresponding to the stored torque for the simulated leg.

In the memory of the microprocessor 20, data are advantageously stored to represent simulated journeys which present variations in the degree of difficulty. Each simulated journey is made up of a series of predetermined levels having different lengths and different gradients simulating a profile of terrain similar to a real road journey.

FIG. 5 shows one simulation as an illustration. The abscissa axis shows the simulated distance DS (or time) and the ordinate axis the simulated gradient PS expressed as a percentage. To a given gradient PS there corresponds a predetermined braking force produced by the strap 16 on the inertia flywheel 15. The simulated journey 100 given as an example is made up of levels 101 to 108. Level 101, for example, simulates a flat section corresponding to a distance of 1 km. Level 102 simulates a section of 0.6 km with a gradient of 4%, and so on. Level 104, for example, which follows two levels representing slopes, represents a level giving the user time to recover.

For each simulated level, the microprocessor 20 stores, for example, data representing the simulated distance and data representing the tensile force on the strap 16, that is the braking force corresponding to the simulated gradient. The microprocessor 20 is programmed to produce the desired control signal for the traction device 19 in response to the measurement signals received from the dynamometric device 21 in order to create the desired braking force for a given simulated distance. The implementation of the programming in the microprocessor is within the normal scope of a person skilled in the art.

Instead of simulating sections of journeys defined by distance, the microprocessor may also be programmed to simulate sections of journeys by duration, controlled by time pulses generated by an appropriate generator.

Throughout the simulation in accordance with the invention, the user is under exercise conditions such as to give him a sensation of speed comparable with that provided by a journey on a real road. At each level of simulation, the sensation of speed which he experiences forces him to react as he would on the road and, as the occasion arises, to select the appropriate gear with the aid of the gear change device with which the bicycle would be fitted, in order to continue the exercise. A selector provided on the microprocessor enables the user to select an exercise program.

In order to offer the user a wide range of simulations enabling him to modify his physical exercise and its difficulty from a menu, the microprocessor 30 advantageously stores a number of different levels of simulated difficulty which the user can select and program in any way he chooses and thereby create a simulation of a profile of terrain adapted to his physical fitness or adapted to his previous performance or desired performance.

The microprocessor 20 offers a visual display of the data selected (simulated distances and difficulties) and of the actual performance (distance covered since starting, instantaneous speed, rhythm, etc.). It can also be programmed to work out the distance covered by the user when he reduces the torque required to accommodate a level of difficulty.

In the embodiment described above the apparatus 10 in accordance with the invention interacts with the chainring of a bicycle which is fitted on the apparatus, as has been seen. However, the apparatus according to the invention may also be constructed with its own pedal drive mechanism. For example, a chainring may be fixed directly to the hub 22 of the drive pinion 23 shown in FIG. 1.

Figure 6:
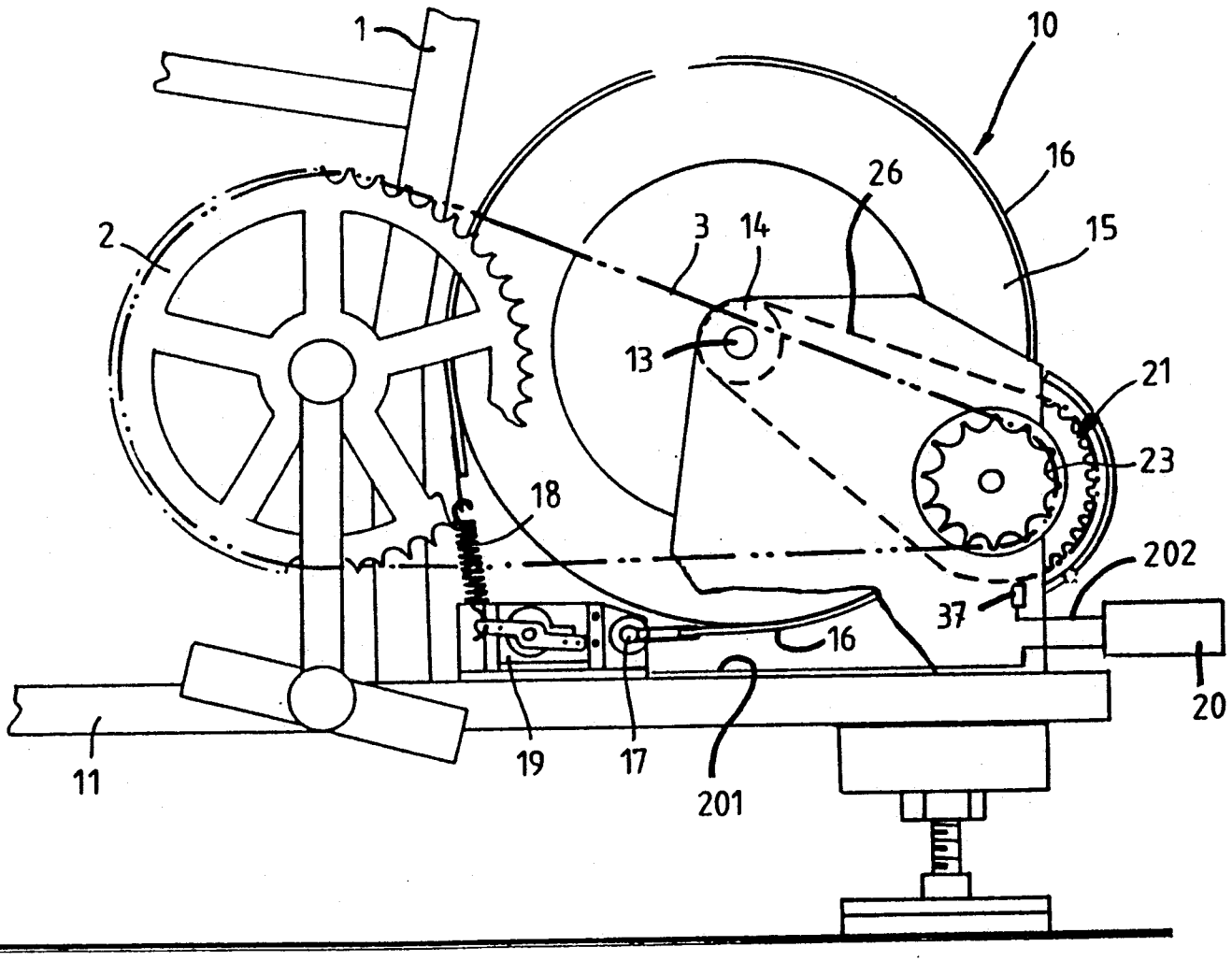
FIG. 6 shows a second illustrative embodiment of the invention.

Another illustrative embodiment is shown in FIG. 6. In this embodiment, a chainring 2 is mounted on a support 1 integral with the stand 11 and this chainring 2 is coupled to the drive pinion 23 by means of a chain 3 in order to drive said drive pinion 23 as in the example seen in FIG. 1. I all other respects, the device 10 is the same as in the previous embodiments and works in the same way.

It will be understood, however, that the invention is in no sense limited to the embodiments described above. Any modification, any variant and any equivalent arrangement is to be considered as falling within the scope of the invention.

I claim:

1. A physical exercise apparatus comprising a stand;

a rotary member mounted on the stand so as to be able to turn freely about a horizontal pin;

an inertia flywheel coupled to the rotary member;

a strap clamped around part of the perimeter of the inertia flywheel, and attached at one end to a pin fixed to the stand and attached at its opposite end to the end of a spring, the other end of the spring being connected to an adjustable traction device mounted on the stand in such a way as to exert a predetermined tensile force on the spring and strap;

a device coupled mechanically to said inertia flywheel for measuring the change in the drive torque relative to the braking force exerted by the inertia flywheel and for producing an electrical signal representing the said change;

said device for measuring the change in the drive torque relative to the braking force comprising a drive pinion designed to be driven by a pedal drive mechanism and a pulley coupled mechanically to the inertia flywheel;

said pulley being also coupled to the drive pinion by means of a number of compressed springs, each spring being held between a first ball fixed to the drive pinion and a second ball fixed to the pulley;

a number of first annular segments fixed to the perimeter of the pulley and a number of second annular segments fixed to the perimeter of the pinion;

the said first and second annular segments being arranged in such a way that the mutually confronting ends of each first annular segment and the consecutive second annular segment are separated, forming a slot which is proportional to the braking force; and a device for measuring the length of said slots and for producing electrical signals representing the change in length of said slots.

2. The apparatus as claimed in claim 1, comprising a microprocessor adapted for comparing an electrical signal representing the drive torque with a signal representing a stored programmed torque and produce a difference signal representing the required change of torque to reach the theoretically required torque for the corresponding leg of a simulated journey, said difference signal being used to control the adjustable traction device thereby to change the braking force exerted on the inertia flywheel in such a way as to reduce the difference in torque to zero.

3. The apparatus as claimed in claim 2, wherein the microprocessor is adapted to store the theoretically required torques for a plurality of simulated journeys.

4. The apparatus as claimed in claim 1, 2 or 3, wherein the strap is a steel band under which there are placed a leather band and/or a textile band, the last-mentioned being in contact with the inertia flywheel, the leather band and the textile band being attached at one end with the steel band to the aforesaid pin while their opposite ends are free.

5. The apparatus as claimed in claim 1, 2 or 3, wherein the rotary member is intended to be coupled to the chainring of a bicycle designed for mounting on the apparatus.

6. The apparatus as claimed in claim 1, 2 or 3 wherein the rotary member is coupled to a chainring which is fixed to the stand.

* * * * *